US006029349A

United States Patent [19]

Berkhout et al.

[11] Patent Number: 6,029,349

[45] Date of Patent: Feb. 29, 2000

[54] INKJET PRINT-HEAD

[75] Inventors: Ronald Berkhout, Maasbree; Godefridus G. H. Gielen, Beringe, both of Netherlands

[73] Assignee: OCE-Technologies, B.V., Venlo, Netherlands

[21] Appl. No.: 08/928,420

[22] Filed: Sep. 12, 1997

[30] Foreign Application Priority Data

Sep. 12, 1996 [NL] Netherlands ..... 1004016

[51] Int. Cl.[7] ..... B41J 2/01; B26D 3/06

[52] U.S. Cl. ..... 29/890.1; 83/875

[58] Field of Search ..... 29/890.1; 83/875, 83/49; 451/57, 58; 347/71

[56] References Cited

U.S. PATENT DOCUMENTS

| | | | |
|---|---|---|---|
| 5,072,240 | 12/1991 | Miyazawa et al. | 29/25.35 |
| 5,078,559 | 1/1992 | Abe et al. | 83/875 |
| 5,680,163 | 10/1997 | Sugahara | 347/71 |
| 5,755,024 | 5/1998 | Drake et al. | 29/890.1 |
| 5,757,404 | 5/1998 | Witteveen et al. | 29/890.1 |
| 5,761,783 | 6/1998 | Osawa et al. | 347/71 |
| 5,761,809 | 6/1998 | Fuller et al. | 29/890.1 |
| 5,786,266 | 7/1998 | Boruta | 83/875 |

FOREIGN PATENT DOCUMENTS

| | | | |
|---|---|---|---|
| 405024203 | 2/1993 | Japan | 29/890.1 |
| WO 9210367 | 6/1992 | WIPO | 29/890.1 |

OTHER PUBLICATIONS

Fabrication of Ink–Jet Printer Head Components by Through–Mask Electrochemical Micromachining, IBM Technical Dischlosure Bulletin, vol. 35, No. 1B, p. 453–454, Jun. 1992.

Japan Abstract: Publication # 04045951, Publication date: Feb. 14, 1992, Applicant: Seiko Epson Corp., Inventor: Narita Toshio, Title: Manufacture Of On–Demand Type Ink Jet Print Head.

*Primary Examiner*—Lee Young
*Assistant Examiner*—A. Dexter Tugbang
*Attorney, Agent, or Firm*—Birch, Stewart, Kolasch & Birch, LLP

[57] ABSTRACT

A method of making a number of adjacent ducts with a required duct side and duct spacing in a duct plate for an inkjet print-head. The method includes the steps of pressing a non-rotating toothed bit from a starting position into the duct plate, moving the bit and the duct plate relatively to one another in such manner that a first groove is cut in the duct plate and returning the bit and/or duct plate to the starting position. The bit is then moved relatively to the duct in a direction of the first groove in such a manner that a subsequent tooth of the bit situated next to the first tooth comes to lie just above the first groove. These steps are then repeated in such manner that the depth of the grooves correspond to the required duct depth.

7 Claims, 5 Drawing Sheets

INKJET PRINT-HEAD

FIELD OF THE INVENTION

The invention relates to a method of producing a number of adjacent ducts in a duct plate for an inkjet print-head and to an inkjet print-head provided with a duct plate produced in this way.

DESCRIPTION OF THE INVENTION

Inkjet print-heads of this kind are used in printing devices and the like. Ink droplets can be discharged from the required ink ducts by controlling the current supply to separate piezoelectric elements, in order to cause expansion of the piezoelectric elements in the direction of the associated ink ducts and thus effect ejection of an ink droplet from an associated ink duct.

The piezoelectric elements usually have a comb-shaped structure and each element is disposed opposite an ink duct. These ink ducts are formed as adjacent grooves in a duct plate, the grooves leading into a nozzle via a nozzle duct. A number of techniques have been applied in the past for making such ink ducts. Laser cutting in a metal duct plate results in a rough melted edge and coarse surface roughness in the base and flanks of the duct, something which is undesirable for good operation of the print-head. Etching techniques have not resulted in uniform ducts and it is also difficult to embody a sloping transition between an ink duct and the nozzle duct.

SUMMARY OF THE INVENTION

The object of the invention is to provide a method to obviate these disadvantages and produce a good inkjet print-head. According to the invention this is possible by making a plurality of adjacent ducts of a required duct depth and duct spacing in a duct plate for an inkjet print-head, the method comprising the steps of:

using a toothed bit having a plurality of teeth with tooth spacing corresponding to the duct spacing;

pressing a first tooth of the bit into the duct plate from a starting position;

cutting a first groove in the duct plate by moving the bit and the duct plate relative to one another;

returning at least one of the bit and the duct plate to the starting position;

moving the bit relative to the duct plate in a direction generally perpendicular to a direction of the first groove in such manner that a subsequent tooth of the bit adjacent to the first tooth lies just above the first groove;

moving the bit and the duct plate again relative to one another in such manner that the subsequent tooth is moved through the first groove and is pressed more deeply into the first groove than the first tooth; and repeating both of the moving steps wherein consecutive teeth of the bit deepen the first groove further and wherein a last tooth of the bit produces the required duct depth.

The use of these steps yields duct plates in which all the ink ducts have exactly the same shape and wherein the walls of the ink ducts and nozzle ducts have very little surface roughness, thus greatly improving the flow behavior of the ink in these ducts. With these methods, it is possible to obtain practically any required transition between the ink duct and the nozzle duct.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
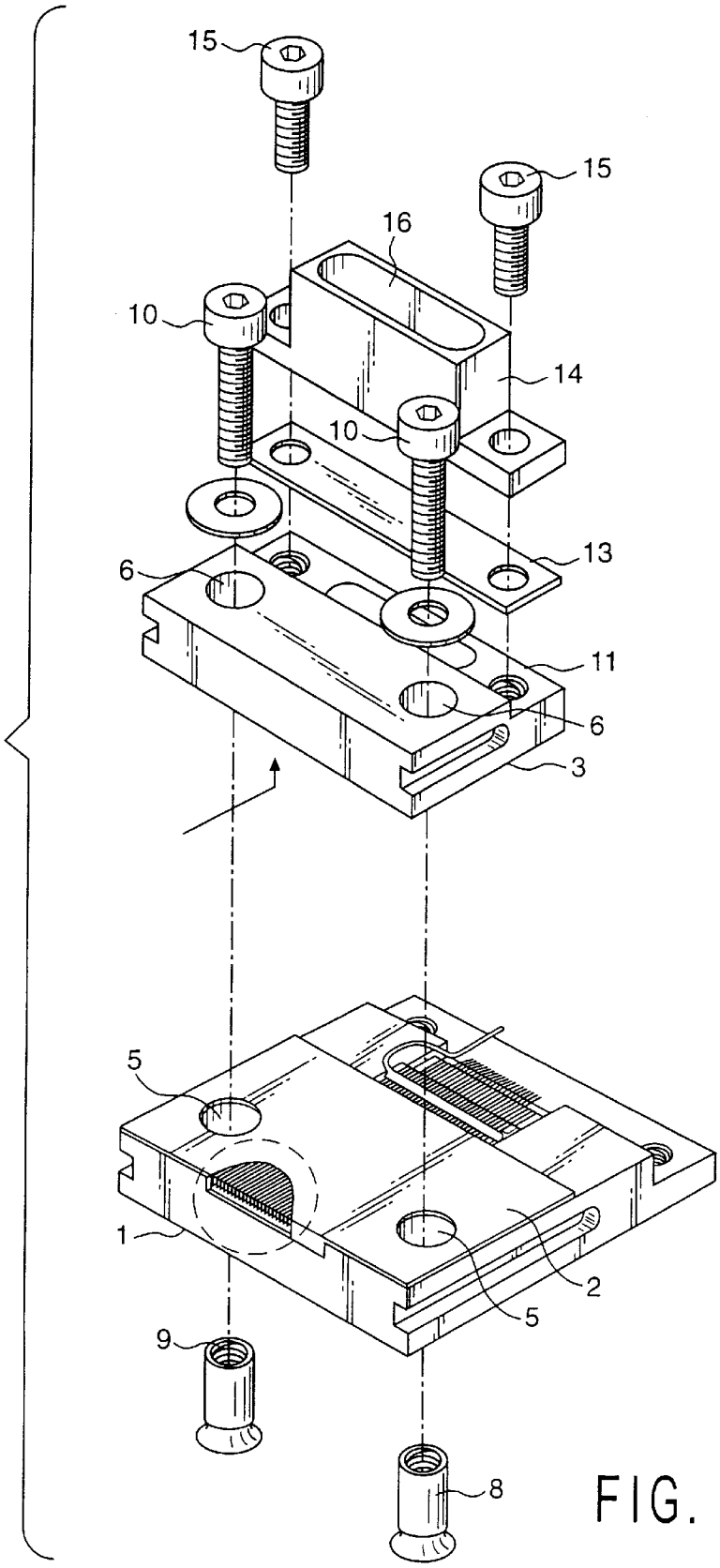
FIG. 1 is a perspective view of an inkjet printhead with the different parts of the inkjet print-head spaced apart, using the duct plate according to the present invention.

As shown in FIG. 1, an inkjet print-head comprises a baseplate 1 for a piezoelectric member to be described in detail hereinafter and which, referring to FIG. 1, is covered at the top of the baseplate 1 by a plastic vibration plate 2.

Figure 6:
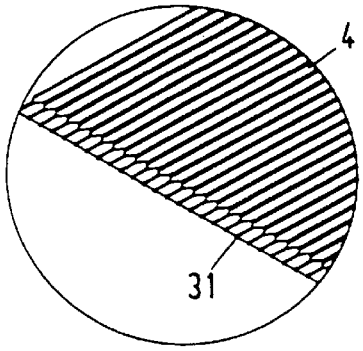
FIG. 6 is an enlarged-scale bottom view of one of the duct plates according to the present invention looking in the direction of the arrow in FIG. 1.

The inkjet print-head also comprises a duct plate 3. A large number of ink ducts 4 extending parallel to one another is disposed in the surface of duct plate 3 facing the baseplate as seen in FIG. 6. Returning to FIG. 1, accurately positioned holes 5 and 6, respectively, are shown disposed in extension of one another in the baseplate 1 and in the duct plate 3. For assembly of the inkjet print-head the duct plate 3 is placed with its surface having the ink ducts 4 on the plastic, glass or metal vibration plate 2, while locating bushes 8 fitting accurately in the holes 5 and 6 are pushed into the relevant holes 5 and 6 for accurately positioning the baseplate 1 and duct plate 3 with respect to one another. The bushes 8 are provided with internally screw threaded bores 9, in which bolts 10 are screwed to fix the baseplate 1 and duct plate 3 against one another. In the case of wide inkjet print-heads, biasing springs or clamping springs can be used to produce the required clamping force. In this way the print-head remains repairable in the event of any faults.

Figure 2:
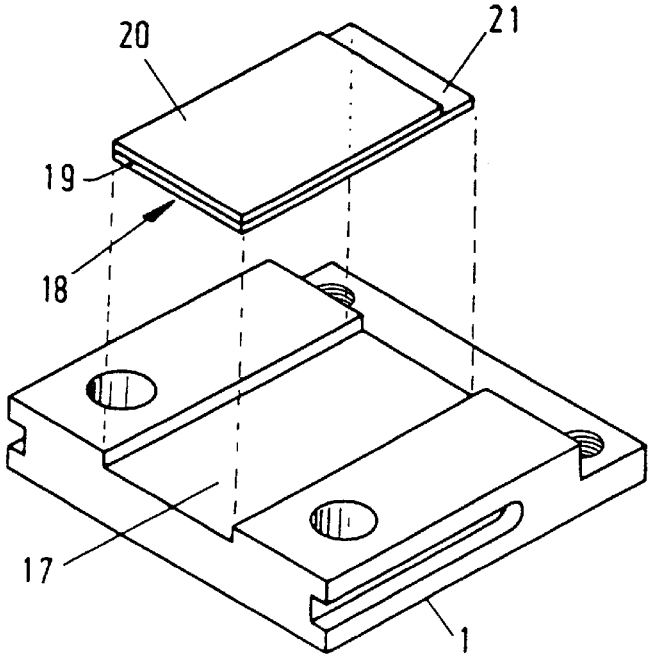
FIG. 2 is a perspective view of a piezoelectric member with a baseplate for the member shown spaced therefrom.

The duct plate 3 is provided with a projecting part 11 formed with an elongate chamber 12 communicating with the ink ducts 4. A block 14 is fixed by means of bolts 15 on the projecting part 11 with the interposition of a packing 13. A chamber 16 is formed in the block 14 and its underside is in open communication with the recess 12 and during operation it is utilized to supply ink to the inkjet print-head As will be seen from FIG. 2, the top surface of the baseplate 1 in FIG. 2 is provided with a recess 17 of rectangular section open at both ends. This recess 17 is intended for the flush mounting of a piezoelectric member 18. This member 18 is built up from a preferably ceramic substrate 19 and a piezoelectric plate 20 stuck to the surface thereof. The surface of the plate 19 facing the plate 20 is covered with a thin metal layer 21. As will be seen from FIG. 2, the construction is such that the plate 19 projects beyond the plate 20 at one end.

Figure 3:
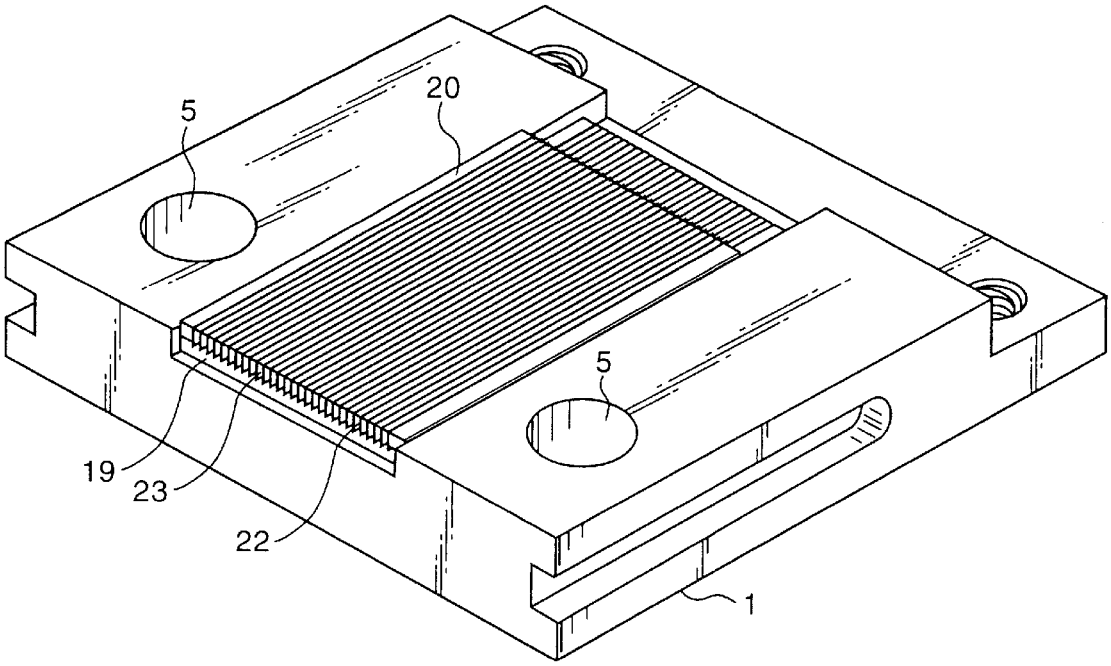
FIG. 3 shows the baseplate of FIG. 2 with the piezoelectric member fixed therein, incisions having been formed in the piezoelectric member to form piezoelectric elements.

The piezoelectric member 18 formed in this way is fixed in the recess 17 in the baseplate 1, e.g. by gluing, in such manner that the coplanar ends of the plates 19 and 20 are to some extent inwardly offset in the recess 17 with respect to the adjacent top surface of the plate 1 as seen in FIG. 3. As will also be apparent from FIG. 3, the length of the ceramic plate 19 is slightly less than the length of the recess 17, so that the plate 19 is supported by the bottom surface of plate 17 over its entire length.

After the piezoelectric member has been fixed in the recess in this way, the baseplate 1 is fixed in a suitable processing machine to form a number of slots extending parallel to one another in the longitudinal direction of the piezoelectric member through the plate 20 and over a small distance into the plate 19, so that the plate 20 is divided up into a large number of piezoelectric elements 23 separated from one another by the slots or incisions 22. During the provision of the incisions or slots 22, at least one of the holes 5 in the baseplate 1 is taken as a basis for a reference in the production of the slots or incisions 22. The holes 5 are accurately dimensioned and disposed. As will be explained in detail hereinafter, this has a favorable effect on the assembly of the inkjet print-head, since these holes 5 in fact also form reference means for the duct plate 3 with respect to the baseplate 1.

After the incisions 22 have been made, the vibration plate 2 is glued on the piezoelectric member 20.

Figure 4:
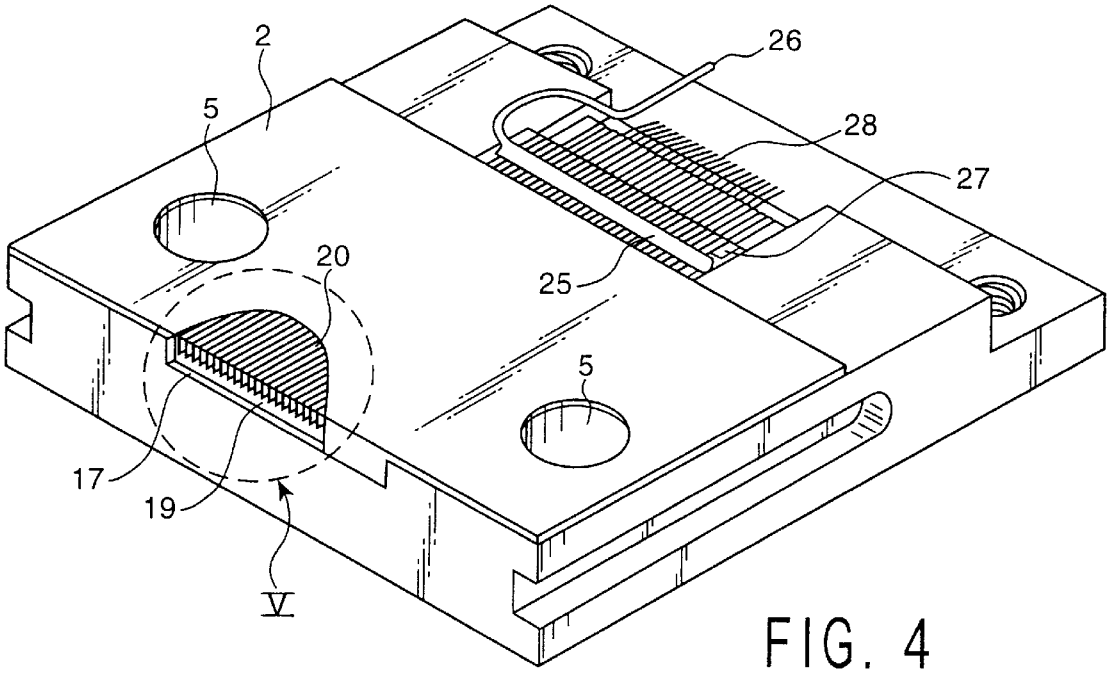
FIG. 4 is an elevation similar to FIG. 3 wherein the piezoelectric member is covered with a vibration plate and connections for the current supply to the piezoelectric elements are provided.
Figure 5:
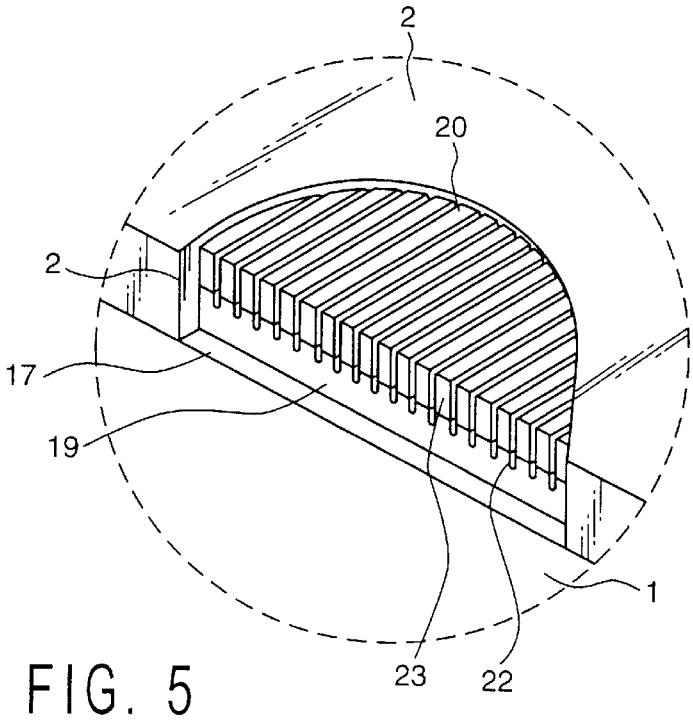
FIG. 5 is an enlarged-scale view of the area encircled by line V in FIG. 4.

As will also be apparent from FIG. 4, the piezoelectric elements project slightly beyond the vibration plate 2. These ends of the piezoelectric elements 23 projecting beyond the vibration plate 2 are interconnected by a conductor 25 which can be earthed by means of a lead 26 when the apparatus is in use.

It will also be clear that the provision of the incisions 22 subdivides the plate 19 at its top covering metal layer 21 into a large number of electrodes 27 each connected to one of the piezoelectric elements 23. A wire 28 is connected to each of these electrodes for current supply.

A number of ink ducts 4 as seen in FIG. 6 extending parallel to one another are formed in the surface of the duct plate 3 facing the baseplate, i.e. the bottom surface of plate 3 in the arrangement shown in FIG. 1. The ink ducts 4 lead into nozzles 31 from which ink droplets can be ejected.

Figure 7:
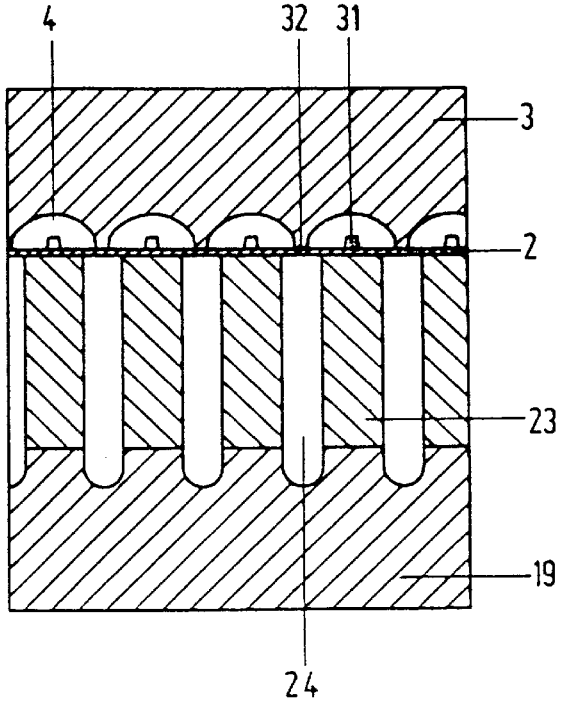
FIG. 7 is a cross-section of part of the piezoelectric member and duct plate.

For the assembly of the inkjet print-head of FIG. 7, the surface of the duct plate 3 formed with the ink ducts is placed on the vibration plate 2, so that the latter comes to bear against ridges 32 which separate the ink ducts from one another and which form part of the duct plate 3, thus providing a good seal between adjacent ink ducts 4.

During this assembly, a piezoelectric element 23 extending parallel to the ink duct will come to bear opposite each ink duct 4 as shown in FIG. 7. This accurate alignment of the piezoelectric elements 23 (of a width of about 200 $\mu$m) with respect to the ink ducts 4 (of a width of about 250 $\mu$m) is achieved simply and efficiently with the holes 5 and 6 in the plates 1 and 3, respectively. These holes 5,6 together with the locating bushes 8 provide accurate positioning of the plates with respect to one another and are utilized as reference means for determining the position for providing the incisions 22 and ink ducts 4, respectively.

After the two plates 1 and 3 have been placed against one another by means of the bolts 10, the top surface of the resulting assembly at which the nozzles 31 discharge can be finished off.

When a piezoelectric element 23 is activated by the supply of a control current via a lead 28, expansion of the relevant piezoelectric element will take place so that part of the vibration plate 2 extending over the piezoelectric element is forced upwards in the associated ink duct 4 of FIG. 7 so that ink is ejected in the form of a droplet via the nozzle 31 of the associated ink duct. Lead 26 is a common electrode which is connected to all the piezoelectric elements via surface 25.

Ink ducts 4 are cut in an aluminum duct plate 3 according to the invention by means of a diamond bit. Sixty-four ducts 4 with a spacing of 0.25 mm between ducts can be formed on a plate about 16×12 mm. Each duct 4 is about 10 mm long and merges into a nozzle duct about 2 mm long and about 0.03 mm wide. The depth of the nozzle duct is about 0.03 mm. Of course, any of these dimensions can be varied in practice if so desired.

The bit is made from natural diamond and is profiled by means of a YG laser in the form of the required duct cross-section and if necessary, is polished with diamond powder. The bit can also be made of synthetic diamond.

The bit is fixed in a holder on a planing bench and the duct plate 3 is fixed on the planing bed. From a starting position the bit is lowered and moved over the duct plate 3, the bit cutting a groove 0.05 mm deep in the duct plate. After the groove has a length of about 10 mm, the bit is lifted in a predetermined manner. The bit then returns to the starting position and is again lowered to the duct plate 3 and cuts a deeper duct in the same groove, now about 0.1 mm. On the next stroke, a depth of about 0.15 mm is cut through the same groove and in a final stroke having a depth of 0.16 mm the first ink chamber is finished. Again, these dimensions could be varied if so desired.

The duct plate 3 is now shifted 0.25 mm in a direction perpendicular to the groove direction and a new duct is cut parallel to the first duct. After 64 ducts have thus been formed a diamond bit having a width of 0.03 mm is clamped in the holder. With this bit, as described above, the nozzle duct is cut in the remaining 2 mm of each duct in the plate 3.

The cutting process can be accelerated by using a comb shape bit. This bit has five teeth next to one another, each in the form of the required duct, with a spacing of 0.25 mm (pitch) between two teeth. The above method can also be applied with this bit but then five ducts are cut simultaneously. When these five ducts are ready the duct plate is shifted 1.25 mm and the cutting process is repeated for five new ducts.

It is also possible to choose for the tooth spacing a multiple of the required distance between two ducts. If, for example, the tooth spacing is 0.5 mm and the required duct spacing is 0.25 mm, then a first group of five ducts is cut in a first operation. The duct plate 3 is then shifted 0.25 mm and the cutting process repeated. The duct plate is then shifted over a distance of 2.5 mm (with respect to the starting position) to a cut a third group of ducts in the duct plate 3. Finally, a nozzle duct is cut adjoining each duct using an 0.03 mm wide bit.

Re-fixing the bit for the nozzle duct after all the ink ducts have been cut may possibly entail tolerance problems because the duct plate has to be re-shifted. A better solution to this problem is to make a holder in which both the bit for cutting the ink duct and the bit for cutting the nozzle duct are mounted. The latter bit is then disposed after the first bit as considered in the direction of the duct. Since the ink duct is deeper than the nozzle duct, the bit for the nozzle duct is also placed somewhat lower.

Using a toothed bit, the identical nature of the teeth must satisfy high requirements in the above-described method. If the teeth differ from one another to some extent, the resulting duct plate 3 has the ink ducts differing from one another as does also the jet behavior of the separate ducts.

Figure 8:
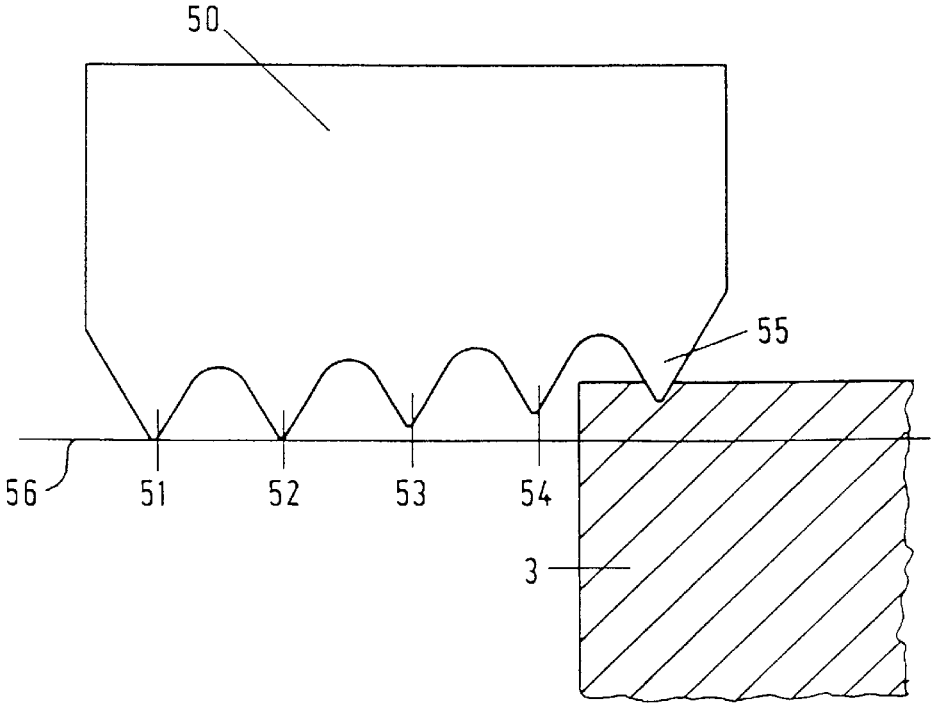
FIG. 8 shows a comb-shaped bit used in one of the methods according to the present invention.

To obviate this, a bit 50 is used as shown in FIG. 8. This diamond bit 50 has five teeth (51–55) as noted above. The first tooth 55 is at a distance of 0.16 mm from line 56, the second tooth 54 a distance of 0.11 mm, tooth 53 is at a distance of 0.06 mm, tooth 52 a distance of 0.01 mm and the fifth and last tooth 51 precisely touches line 56. From a starting position the first tooth 55 is brought in front of the duct plate 3 and towards it perpendicularly to the drawing plane. The tooth 55 is about 0.04 lower than the surface of the duct plate 3 and on further advance this tooth 55 cuts a first groove about 0.04 mm deep in the duct plate.

In a following stroke, the duct plate 3 is moved to the left over the pitch of the teeth of the bit 50 (0.25 mm). In these circumstances, tooth 54 will be situated just in front of the first groove and on further advance tooth 54 will deepen the first groove to about 0.09 mm. Tooth 55 will at the same time cut a new groove 0.04 mm deep in the duct plate. This process is repeated and after four cutting operations and shifting of the duct plate the first groove will be situated just in front of the last tooth 51. This tooth 51 has exactly the required shape of the ducts and on a fifth movement of the bit 50 in a direction perpendicular to the drawing plane the first groove will have obtained the finally required shape and depth. The entire process is continued until the last groove (the $64^{th}$) has obtained the required shape by means of tooth 51. Since the final groove for each duct is always cut with tooth 51, all the ducts are exactly the same.

Figure 10:
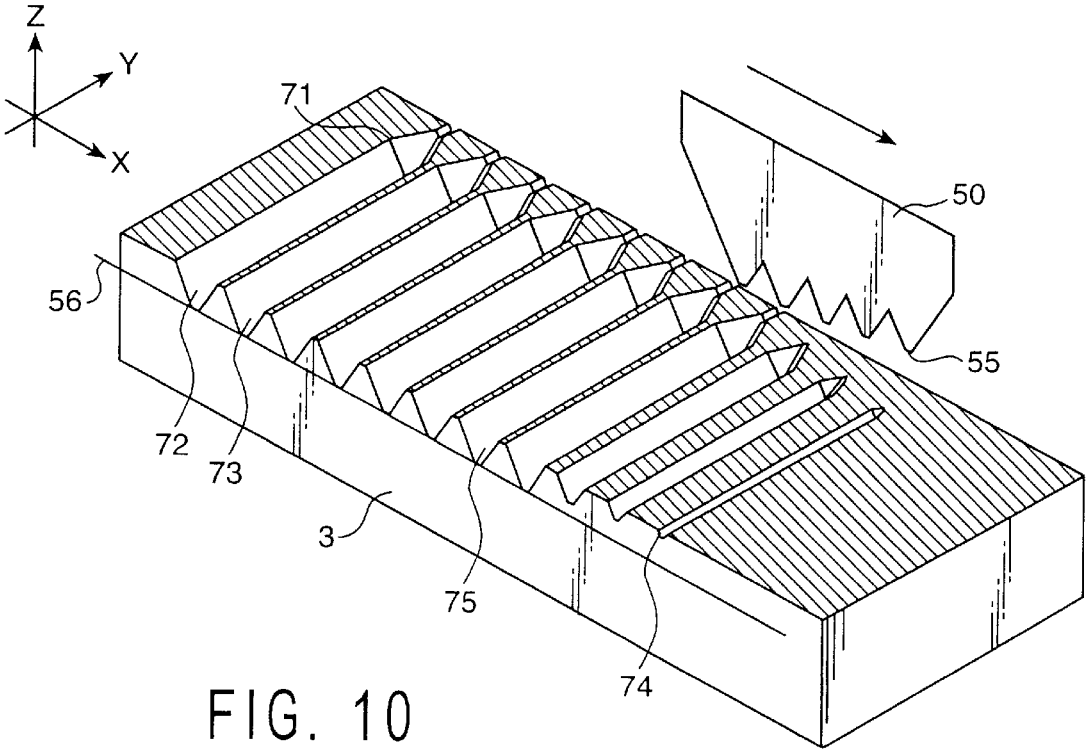
FIG. 10 shows a duct plate during the use of a bit of the kind shown in FIG. 8.

FIG. 10 shows this process three-dimensionally. Bit 50 is moved in the Y-direction over duct plate 3, the first tooth 55 being brought opposite groove 72. After the first groove has been cut, the bit 50 is returned and shifted as described above over the pitch in the X-direction and then again taken over the plate in the Y-direction, the first tooth 55 cutting groove 73. The drawing shows the situation where the bit 50 has advanced to an extent such that tooth 55 has cut groove 74. In this situation, tooth 51 has cut duct 75 exactly to depth.

The bit is always moved in the Y-direction to a fixed depth until point 71 is reached. Bit 50 is then moved in the Z-direction also in predetermined manner, the nozzle duct being formed. On the lifting of the bit and simultaneous advance in the Y-direction, a high degree of form freedom of the ink duct nozzle is obtained. Finally, the nozzle duct is cut over the last 2 mm in the manner described hereinbefore.

Figure 9:
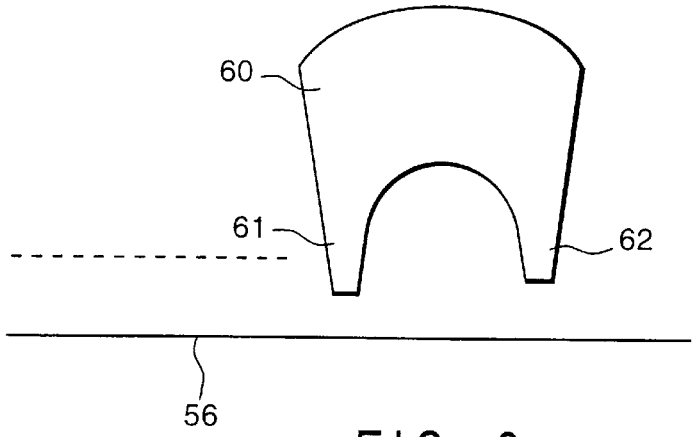
FIG. 9 shows another comb-shaped bit used in one of the methods according to the present invention.

FIG. 9 shows another bit 60 used for cutting the nozzle ducts. This bit has a first tooth 62 for pre-cutting the nozzle duct and a second tooth 61 for the final shape of the nozzle duct. The bit 60 is clamped together with bit 50 FIG. 8 in a holder. Tooth 61 of bit 60 is exactly in line with tooth 51 of bit 50 as considered in the direction of the grooves. Bit 60 is disposed after bit 50 as considered in the direction of movement of the bits. Bit 60 is also so disposed that the distance of tooth 61 from the line 56 of FIG. 8 corresponds to the required difference in depth of the ink duct and nozzle duct. If the bit 50 is so adjusted that a groove of 0.2 mm depth is cut in the duct plate 3, then the distance between line 56 and tooth 61 of FIG. 9 is 0.17 mm, so that a nozzle duct having a depth of 0.03 mm is obtained.

The above-described inkjet print-head is particularly intended for use with ink which is solid at a room temperature (hot-melt inkjet system) and having a melting temperature of from 60° C. to 130° C. To keep the ink in the fluid condition during operation, a heating element (not shown) can be disposed for example beneath the baseplate 1. Since the plate 20 of FIG. 1 is divided up into a number of completely separate piezoelectric elements 23 disposed on the ceramic material substrate 19, heating of the inkjet print-head will not cause the coefficient of expansion of the piezoelectric material to shift the piezoelectric elements 23 with respect to the duct plate 3 and thus coming next to the ink ducts 4. This is the case particularly if the duct plate 3 is also made of ceramic material. Good operation at elevated temperature is also obtained with a duct plate 3 made of a metal or plastic whose coefficient of expansion is not all too different from that of the substrate 19.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method for making a plurality of adjacent ducts of a required duct depth and duct spacing in a duct plate for an inkjet print-head, the method comprising the steps of:

using a toothed bit having a plurality of teeth with tooth spacing corresponding to the duct spacing;

pressing a first tooth of the bit into the duct plate from a starting position;

cutting a first groove in the duct plate by moving the bit and the duct plate relative to one another;

returning at least one of the bit and the duct plate to the starting position;

moving the bit relative to the duct plate in a direction generally perpendicular to a direction of the first groove in such manner that a subsequent tooth of the bit adjacent to the first tooth lies just above the first groove;

moving the bit and the duct plate again relative to one another in such manner that the subsequent tooth is moved through the first groove and is pressed more deeply into the first groove than the first tooth while the first tooth simultaneously cuts an adjacent second groove; and repeating both of the moving steps wherein consecutive teeth of the bit deepen the first groove further and wherein a last tooth of the bit produces the required duct depth.

2. The method according to claim 1, further comprising the step of removing the bit from the duct plate in a predetermined manner at the end of the groove.

3. The method according to claim 1, further comprising the step of using a diamond bit as the bit.

4. The method according to claim 1, further comprising the step of using a second bit, the second bit being disposed after the first bit as considered in the groove direction, the second bit being used to cut a nozzle duct.

5. The method according to claim 4, wherein at least the first groove when having the required depth generally has a v-shape and wherein the method comprising the step of using a generally v-shaped tooth as the last tooth.

6. The method according to claim 5, wherein the second bit has a plurality of teeth and wherein the nozzle duct generally has an arcuate shape and wherein the method further comprises the step of using at least one tooth with a curved end in the second bit.

7. The method according to claim 1, wherein at least the first groove when having the required depth generally has a v-shape and wherein the method comprising the step of using a generally v-shaped tooth as the last tooth.

* * * * *